US007454802B2

(12) United States Patent
Tennant et al.

(10) Patent No.: US 7,454,802 B2
(45) Date of Patent: Nov. 25, 2008

(54) DRAIN SYSTEM FOR TUB

(75) Inventors: Scott Tennant, Lawrenceville, NJ (US); Steve Deland, Berkeley Heights, NJ (US)

(73) Assignee: Acryline USA, Inc., Cliffwood, NJ (US)

( * ) Notice: Subject to any disclaimer, the term of this patent is extended or adjusted under 35 U.S.C. 154(b) by 415 days.

(21) Appl. No.: 10/978,656

(22) Filed: Nov. 1, 2004

(65) Prior Publication Data

US 2006/0090256 A1 May 4, 2006

(51) Int. Cl.
*A46H 33/06* (2006.01)

(52) U.S. Cl. ..... 4/541.4; 4/541.1

(58) Field of Classification Search ..... 4/541.1–541.6
See application file for complete search history.

(56) References Cited

U.S. PATENT DOCUMENTS

| | | | | |
|---|---|---|---|---|
| 1,034,919 | A * | 8/1912 | Leuschner | 4/541.4 |
| 2,856,611 | A * | 10/1958 | Stamatis | 4/541.5 |
| 3,251,071 | A * | 5/1966 | Wood | 4/541.5 |
| 4,000,528 | A | 1/1977 | Posnick | |
| 4,122,846 | A | 10/1978 | Baumann | |
| 4,166,296 | A | 9/1979 | Darrah et al. | |
| 4,249,522 | A | 2/1981 | Carrier | |
| 4,672,692 | A | 6/1987 | Savage | |
| 4,796,310 | A | 1/1989 | Freville et al. | |
| 4,901,379 | A | 2/1990 | Chalberg et al. | |
| 5,548,854 | A | 8/1996 | Bloemer et al. | |
| 5,930,851 | A | 8/1999 | Brunelle | |
| 6,052,844 | A | 4/2000 | Walsh et al. | |
| 6,122,775 | A | 9/2000 | Jacuzzi et al. | |
| 6,279,177 | B1 | 8/2001 | Gloodt | |
| 6,357,060 | B2 | 3/2002 | Gloodt | |
| 6,427,257 | B1 | 8/2002 | Castellote | |
| 6,477,724 | B1 | 11/2002 | Brunelle et al. | |
| 2003/0233704 | A1 | 12/2003 | Castellote | |
| 2003/0154545 | A1 | 9/2004 | Sangha et al. | |

OTHER PUBLICATIONS

Website printout, www.keidel.com, Hot Air Tubs.

* cited by examiner

*Primary Examiner*—Huyen Le
(74) *Attorney, Agent, or Firm*—Lerner, David, Littenberg, Krumholz & Mentlik, LLP

(57) ABSTRACT

An air massage bathtub is disclosed. The air massage bathtub includes a bath well defined by side walls and a bottom portion. The bottom portion includes a recessed area with a drain located within to the recessed area. The bathtub further includes a channel located at least partially below said bath well and in communication with the recessed area, and a plurality of apertures each of which extends through the bath well and into the channel.

29 Claims, 6 Drawing Sheets

DRAIN SYSTEM FOR TUB

FIELD OF THE INVENTION

The present invention relates to bathtubs, and more particularly, to air massage bathtubs.

BACKGROUND OF THE INVENTION

Air massage bathtubs are well known and widely utilized in many households and health clubs around the world. Essentially, an air massage bathtub is a typical bathtub having the ability to inject warm air into water that has been filled in the tub. One type of air massage system is a channel-type system. In a channel-type system, a cavity or channel surrounds the bathtub above the bottom of the bath well. Several holes are drilled through the surface of the tub and into the channel. In operation, air is directly blown into the channel and escapes through the holes, thereby creating the massaging effect that is particularly useful in soothing the body. After bathing the water is removed from the tub through a drain similar to those utilized in standard bathtubs. Unlike spas or hot tubs, this type of system requires a user to draw and drain a bath for each use.

Air massage bathtubs have many advantages over other water massaging tubs. For example, the ability place the air compressor necessary for the operation of the air massage tub at any location allows for less floor space to be required than the standard whirlpool tub that must be fixed in place with its pump. Additionally, the fact that air massage bathtubs do not recirculate water through jets, means that it is safe to use bath oils, sea salts and therapeutic mud masks. However, air massage bathtubs, especially air channel systems, are not without their drawbacks.

The placement of the various holes in the tub may allow for water to enter and remain in the aforementioned channel after use. Residual water such as this enhances the possibility that bacteria and other pathogens may become present in the system. Subsequent uses of the tub will introduce such undesirable particles into the water and into contact with the user. Many prior art systems combat this problem by providing a channel that allows this water to gravity drain into the bath well, where it flows into a drain. Some other systems also provide a mechanical drying cycle where, after a certain amount of time subsequent the use of the tub, air is forced through the channel to clean out excess moisture from the channel. In many instances, however, even a combination of these solutions does not sufficiently dry the channel. Thus, in the prior art, an unacceptable amount of water remains in the air channel of the system.

In view of the above-noted deficiencies in the prior art, there remains a need for a drain system that allows for higher drainage rates of water from an air channel after using the system and draining water from the tub.

SUMMARY OF THE INVENTION

A first aspect of the present invention is a bathtub. The bathtub according to this aspect includes a bath well defined by side walls and a bottom portion where the bottom portion has a recessed area, a drain located within the recessed area, a channel located at least partially below the bath well and in communication with the recessed area and a plurality of first apertures in the bath well, at least some of the first apertures extending into the channel.

Another embodiment of the present invention is another bathtub. The bathtub according to this embodiment includes a bath well defined by side walls and a bottom portion where the bottom portion has a recessed area, a drain located within the recessed area, a channel located at least partially below the bath well, a plurality of first apertures in the bath well extending into the channel and a blower for forcing air into the channel and through the first apertures.

Yet another embodiment of the present invention is yet another bathtub. The bathtub according to this embodiment includes a bath well defined by side walls and a bottom portion including a recessed area, a drain located within the recessed area, a channel, where a portion of the channel extends at least partially around the recessed area, a plurality of first apertures in the bath well extending into the channel and at least one second aperture in the recessed area in communication with the portion of the channel that extends at least partially around the recessed area, the at least on second aperture allowing fluid located within the channel to drain in said drain.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

In describing the preferred embodiments of the subject matter illustrated and to be described with respect to the drawings, specific terminology will be used for the sake of clarity. However, the invention is not intended to be limited to any specific terms used herein, and it is to be understood that each specific term includes all technical equivalents which operate in a similar manner to accomplish a similar purpose.

Figure 1:
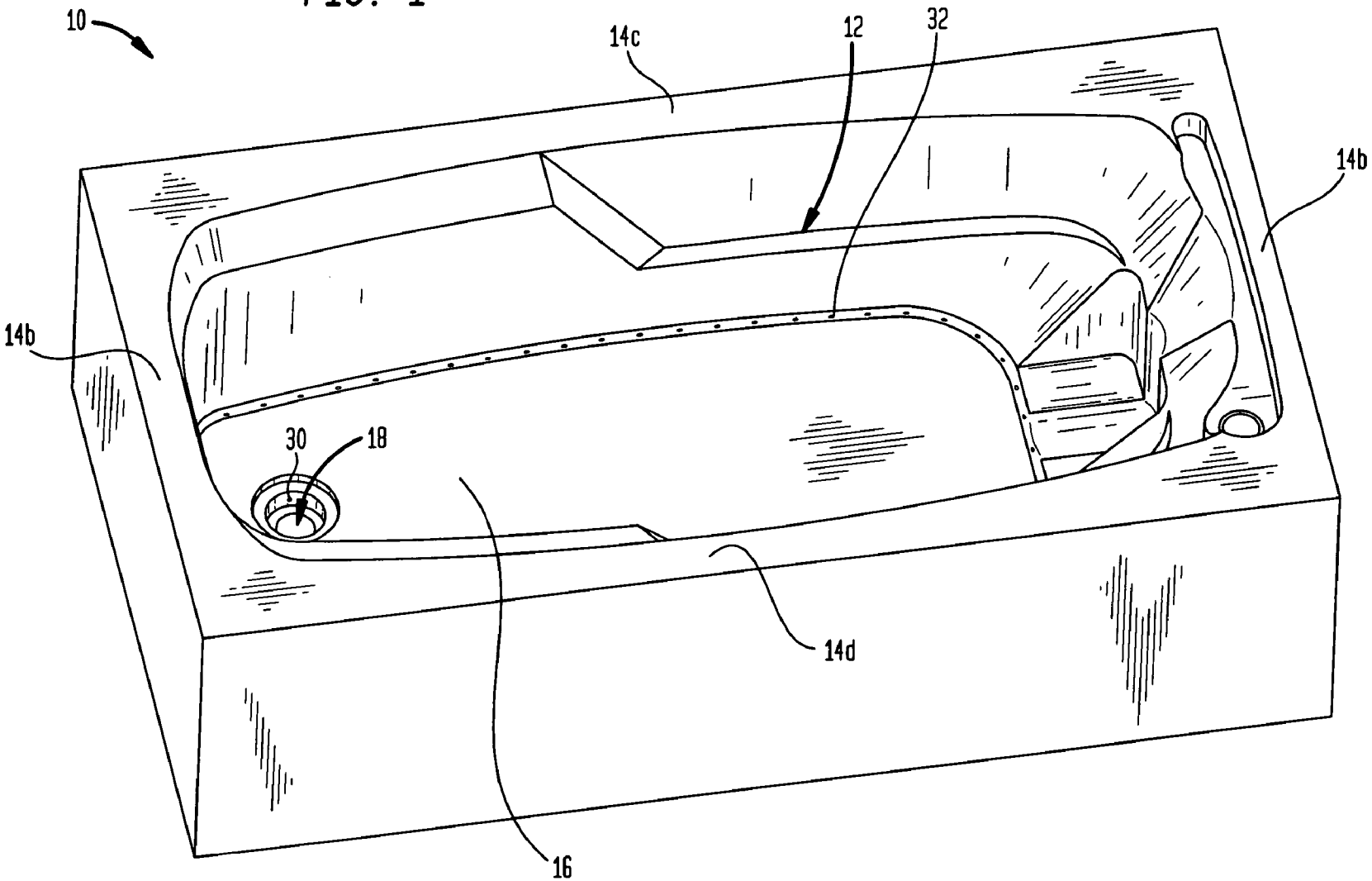
FIG. 1 is a perspective view of a bathtub, in accordance with certain embodiments of the present invention.

Referring to the drawings, wherein like reference numerals represent like elements, there is shown in FIGS. 1-6, in accordance with embodiments of the present invention, an air massage bathtub designated generally by reference numeral 10. As best shown in FIG. 1, bathtub 10 includes a bath well 12 defined by side walls 14*a*, 14*b*, 14*c*, and 14*d* and bottom portion 16. Bath well 12 is preferably sized and configured to allow at least one person to fit therein. It is contemplated that side walls 14*a*, 14*b*, 14*c*, and 14*d* can be configured so as to allow a person to relax in a comfortable position. For example, as is shown in the figures, sidewall 14*b* is angled so as to allow a person to recline with their back towards it. However, other bath well designs than those shown, as are known in the art, are contemplated. For example, it is contemplated that bath well 12 can be adapted to allow for more than one person to be comfortably positioned within it. Further, ergonomic designs are contemplated for providing support for different parts of the body. Bath well, 12 is typically constructed of any material known in the art to be suitable for the construction of bathtubs. For example, acrylic, ceramic, fiberglass, or metallic materials, as well as combinations of the same.

Figure 2:
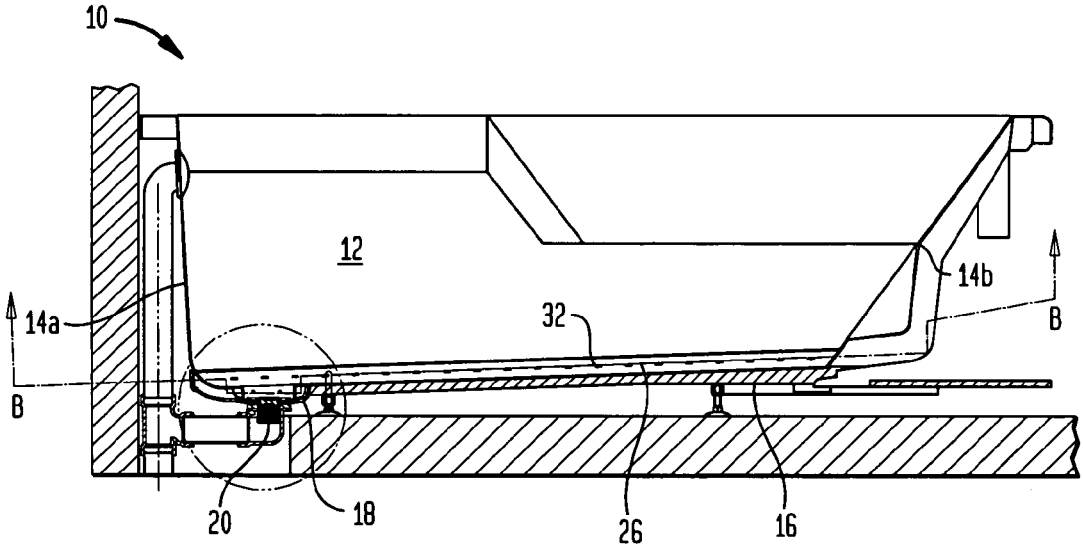
FIG. 2 is a cross-sectional side view of a bathtub shown in FIG. 1.
Figure 3:
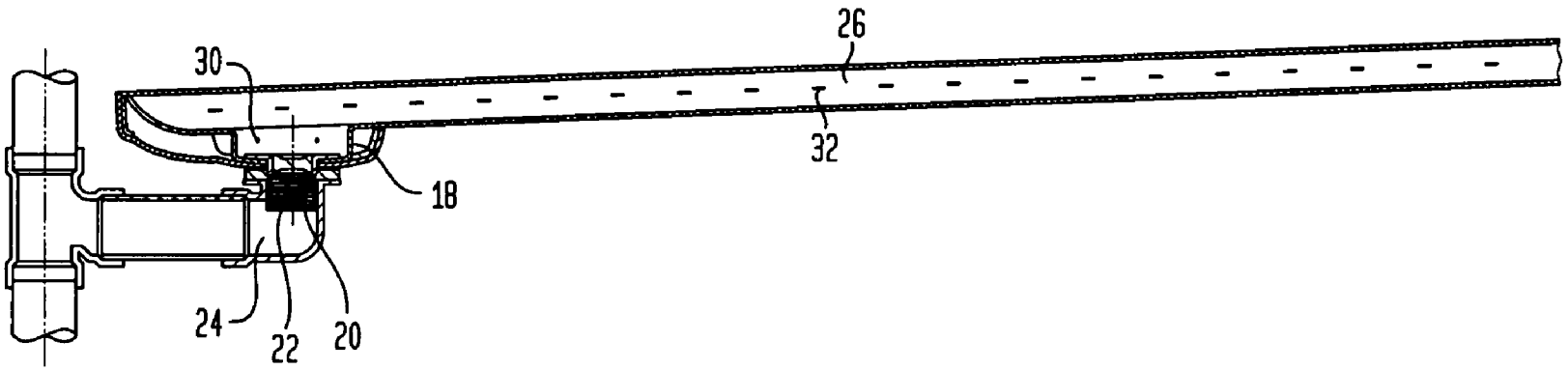
FIG. 3 is a more detailed cross-sectional side view of the recessed area and drain assembly of the bathtub shown in FIG. 2.
Figure 4:
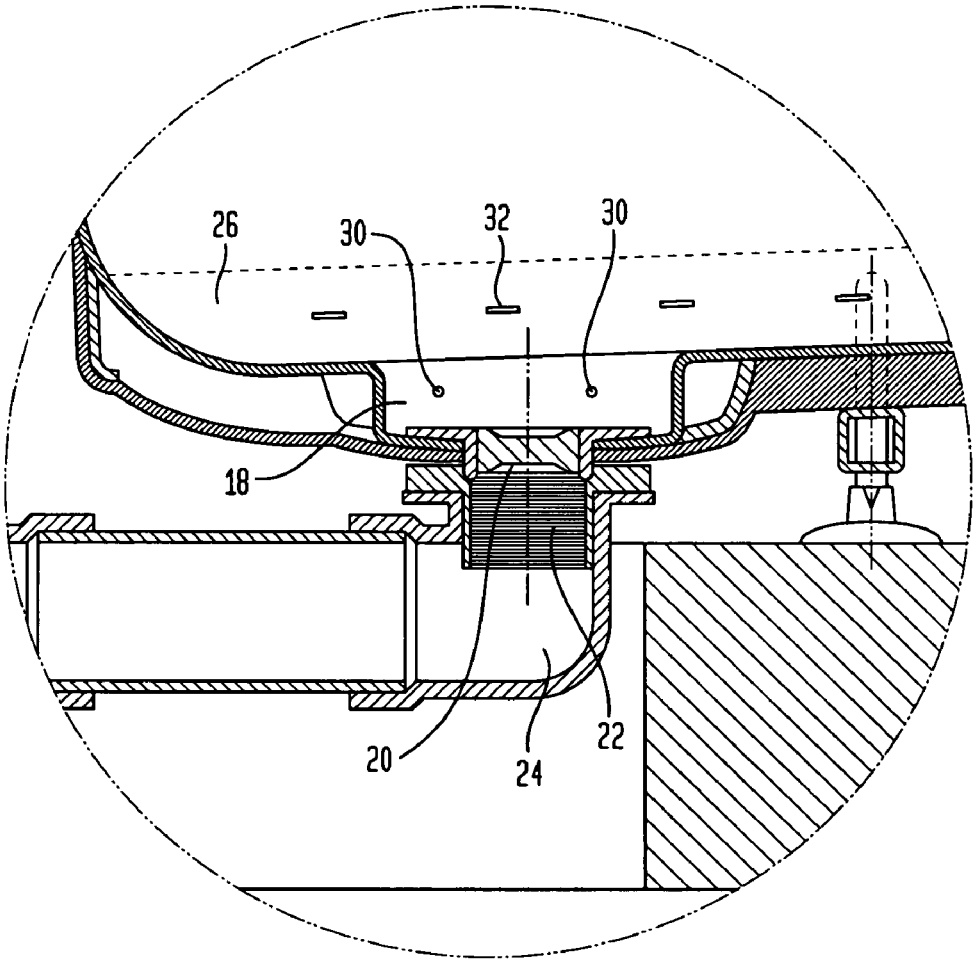
FIG. 4 is a more detail cross-sectional side view of the recessed area and drain assembly shown in FIG. 3.

Bottom portion 16 is designed for the support of a person, and may include sections designed for comfort. As is best shown in FIG. 2, bottom portion 16 further includes recessed area 18, for aiding in the draining of bath well 12. Essentially, recessed area 18 is a depression in bottom portion 16 that allows water contained in bath well 12 to drain into drain assembly 20. The recessed area 18 and the drain assembly 20 are shown in more detail in FIGS. 3 and 4. It is contemplated that drain assembly 20 may be any drain assembly as is known in the art, and, as is best shown in FIG. 4, may include a bathtub drain 22 for selectively allowing/preventing the draining of water from bath well 12 and a drain pipe 24 leading to a waste water system. Bathtub drain 22 may be any standard drain as is readily known in the art, and drain pipe 24 should be capable of being connected to already existing waste water piping. In preferred embodiments, like those shown in the Figures, bottom portion 16 may be pitched or tilted towards to recessed area 18 so that water within bath well 12 is forced to run into recessed area 18, and thus through drain pipe 24, upon the opening of drain 22. It is contemplated that recessed area 18 may be recessed at any level below bottom portion 16, the only requirement will be discussed below in relation to it cooperation with the channel structure. Similarly, it is contemplated that recessed area 18 may be of any shape and/or size in bottom portion 16.

Figure 5:
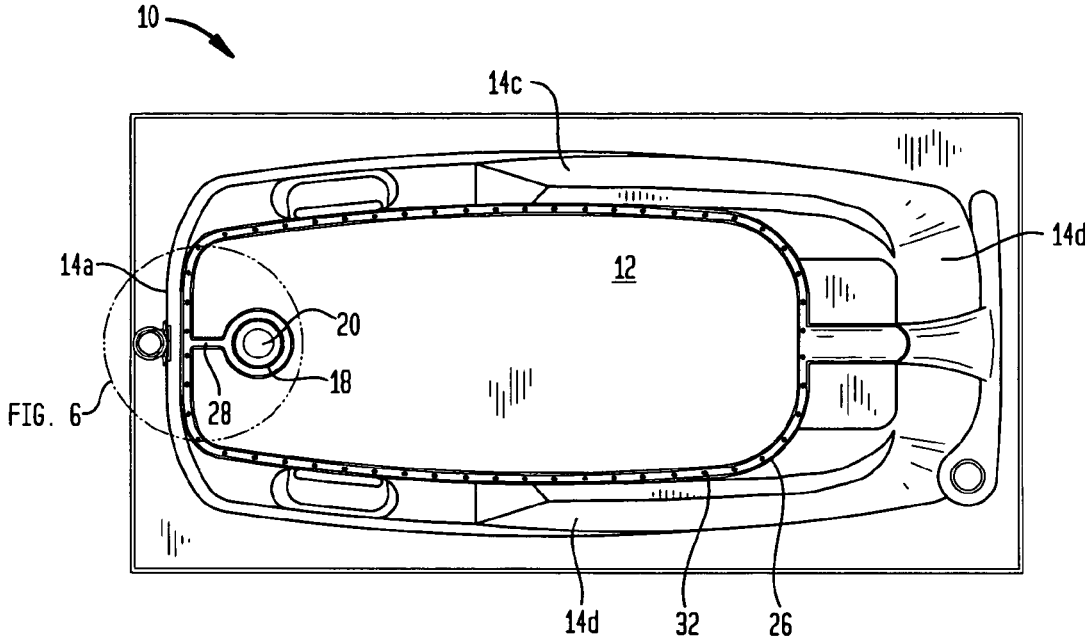
FIG. 5 is a cross-sectional view of the bathtub shown in FIG. 2 taken along line B-B thereof.
Figure 6:
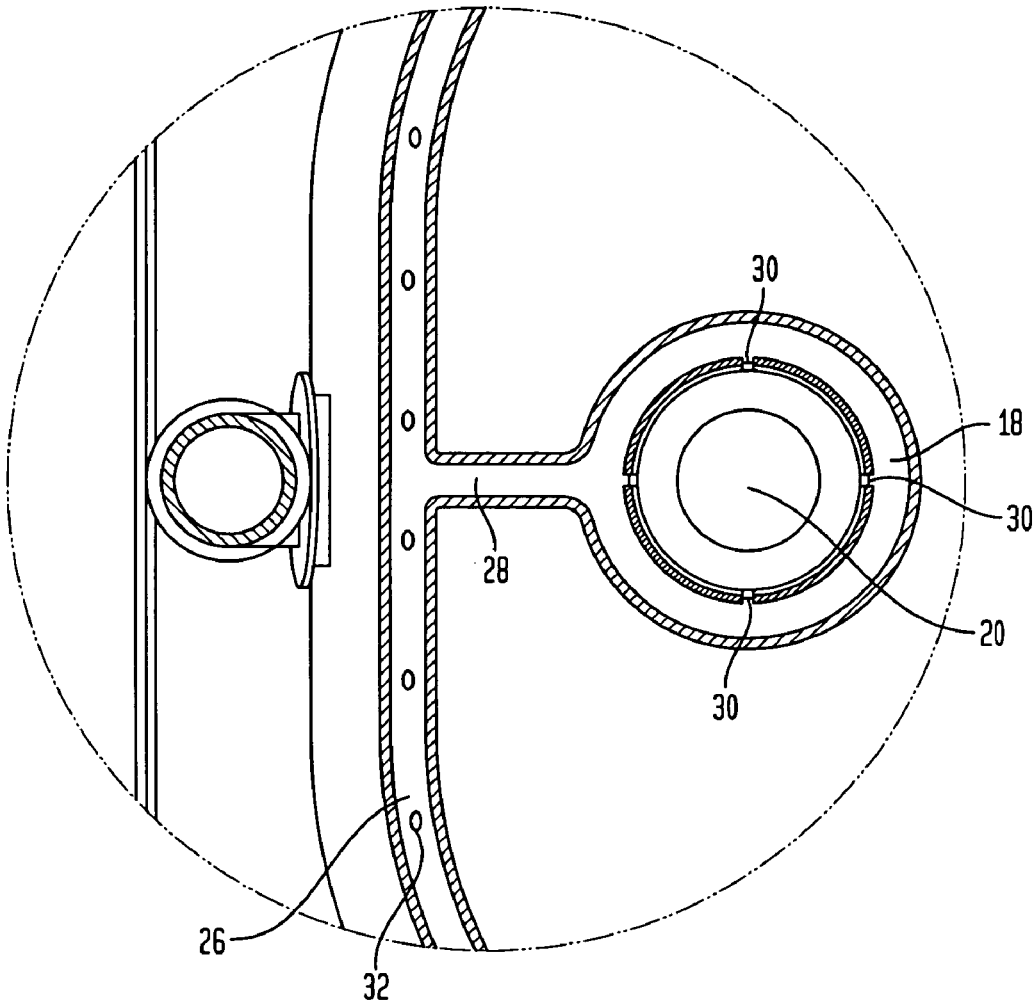
FIG. 6 is a more detailed cross-sectional view of the recessed area shown in FIG. 5.

As best shown in FIGS. 2 and 5, bathtub 10 further includes a channel 26 located at least partially below bath well 12. Channel 26 is preferably a hollow structure that extends around and beneath bath well 12, and is in fluid communication with recessed area 18, so that any liquid contained in channel 26 can drain directly into drain assembly 20. This cooperation is more clearly depicted in FIGS. 5 and 6, where channel extension 28 is shown connecting channel 26 to recessed area 18. Further, drain holes 30 provide the openings necessary to allow water in channel 26 to flow into recessed area 18. It is noted that in order for water contained within channel 26 to drain properly into recessed area 18, recessed area 18 must be located at a depth that allows channel 26 to drain water into recessed area 18, but above drain assembly 20. In certain embodiments, like the aforementioned bottom portion 16, channel 26 may be pitched or tilted towards recessed area 18. This allows for the more complete draining of any water held within channel 26. Essentially, as best shown in FIGS. 4 and 6, any water contained within channel 26 will gravity drain towards side wall 14*a*. Channel extension 28 provides a passage between channel 26 towards recessed area 18 and extends at least partially around the recessed area. In certain embodiments like those shown in the Figures, channel extension 28 extends completely around recessed area 18. The water that has gravity drained towards side wall 14*a* will once again be forced to gravity drain through channel extension 28 and towards recessed area 18, where it exits through drain holes 30. This in turn allows for any water contained within channel 26 to drain directly into drain assembly 20, without ever being forced in bath well 12.

It is contemplated that channel 26 can be of any size or shape, and can be situated around bath well 12 in any fashion. For example, in certain embodiments like those shown in the drawings, channel 26 is continuous and extends entirely around the perimeter of bottom portion 16 of bath well 12. In other embodiments, channel 26 may be non-continuous and situated around any portion of bath well 12. Channel 26 may also be connected to a blower, compressor or other compressed air source, as well as a heater (not shown) so that air may enter bath well 12, as will be discussed further below.

Bathtub 10 further includes a plurality of apertures 32. As shown in the figures, apertures 32 are essentially holes extending through bath well 12 and into channel 26. These apertures 32 are designed to allow for air to travel into and out of bath well 12 and channel 26. Although, as discussed further below, water may also travel therethrough. Apertures 32 are typically sized and shaped to allow for a massaging effect to occur when air is blown through channel 26 and into a filled bath well 12. In the embodiment shown in the Figures, apertures 32 extend around the perimeter of bottom portion 16 along the same path as that of channel 26. However, it is contemplated that apertures 32 can be situated in any manner that allows for their fluid communication with channel 26. For example, in certain embodiments, apertures 32 are formed through bottom portion 16 or side walls 14*a-d*. It is also contemplated that apertures 32 can be situated so that the entire body of a user or specific portions of a user's body are targeted by the operation of the bathtub.

The aforementioned blower or compressed air source (not shown) may be any blower that is suitable for producing and forcing enough air through channel 26 to create a massaging effect in a filled bath well 12. Blowers of this type are well known in the art and readily utilized on existing air massage bathtubs. The connection of the blower and channel 26, while often determined by the type of blower, is also well known and readily utilized on existing air massage bathtubs. Similarly, heaters (also not shown) suitable for use with the present invention are well known. The use of such a heater may allow for the introduction of heated air into a filled bath well 12, thus enhancing the massaging effect. It is contemplated that different blowers and heaters may be utilized depending upon the size of bath well 12 or the massaging effect desired. In order to properly control the massaging effect of the present invention, it is contemplated that bathtub 10 may include controls for operating the functions of the blower or heater. For example, a control may be supplied that allows a user to vary the amount of air blown through channel 26 and/or the temperature of such air. As with the blower and heater elements, controls of this type are widely used and well known in the art.

In operation, a user first fills bath well 12 to a desired water fill level. This may be accomplished with or without the user already situated in bath well 12. It is noted that air massage bathtubs typically do not preclude the use of bath oils or the like because the massaging effect is created by the introduction of air, rather than the recirculation of water. Therefore, such additional therapy elements may be introduced into the water at any time without the worry of clogging or corroding the mechanical aspects of the tub. Once the desired water fill level is achieved, the user may turn on the blower and/or heater elements. To accomplish this, the aforementioned control may be utilized. When sufficient air begins to blow through channel 26 and into bath well 12 through apertures 32, the massaging effect may be felt by the user. Depending upon the amount of water and/or the level of heat applied to the air, the temperature of the water contained within bath well 12 may also begin to rise.

After the user is finished with his or her massaging bath, the water is drained from bath well 12. As mentioned above, bathtub drain is operated to allow water to flow therethrough and into drain pipe 24. As was also mentioned above, bottom portion 16 may be pitched or tilted towards recessed area 18 so as to allow for the gravity draining of the water. This allows for the often vast amount of water to drain at a quicker rate. Unfortunately, the passages formed by apertures 32 through bath well 12 into channel 26 creates the possibility of residual water entering and remaining within the channel during times when air is not forced into channel 26. As discussed in the background section, prior art systems often combat this problem by allowing their channels, which reside above the bath well, to gravity drain into the bath well and through their drains. Additionally, some of these systems also provide a mechanical dry cycle, where after a certain amount of time subsequent to the use of the tub, the blower is re-activated for a short period to force the residual water out of the channel and into the bath well. The present invention provides channel 26, situated in a tilted fashion below bath well 12 and in fluid communication with recessed area 18. As discussed above, this design allows gravity to force the residual water to flow directly from channel 26, through channel extension 28, out of drain holes 30, into drain assembly 20, and eventually to the waste water system. This creates a more efficient channel draining system that offers a significantly higher drainage rate over those of the prior art.

While the design of channel 26 of the present invention may alone provide for a significant improvement over the prior art, it is also contemplated to include a mechanical drying cycle. Essentially, the blower and/or any controls associated with the blower provide the drying cycle at a predetermined time after the use of the tub. For example, the present invention may be configured so as to actuate the blower for a period of about sixty seconds approximately beginning approximately fifteen minutes after use. This cycle allows bath well 12 and channel 26 to initially gravity drain and then forces any remaining residual water in channel 26, which has not gravity drained into recessed area 18, to be either forced through channel extension 28 and into recessed area 18 or through apertures 32 and into bath well 12 where it can then gravity drain into recessed area 18. It is contemplated that this mechanical drying cycle can be configured to operate at any time for any amount of time after using the tub. In embodiments of the present invention that incorporate a mechanical drying cycle such as this, the drainage percentage of the volume of space within channel 26 may be greater than 97% and, in fact, may be even substantially higher than 99%.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A bathtub comprising:

a bath well defined by side walls and a bottom portion, said bottom portion including a recessed area extending below and surrounded by said bottom portion;

a drain located within the recessed area;

a channel located above said bottom portion and extending substantially around said bath well, said channel disposed outside of said bath well;

a channel extension arranged between said channel and the recessed area such that said channel is in communication with the recessed area; and a plurality of first apertures in said bath well, at least some of said first apertures extending into said channel.

2. The bathtub according to claim 1, wherein at least a portion of said channel is tilted towards the recessed area.

3. The bathtub according to claim 1, wherein a portion of said channel extends at least partially around the recessed area.

4. The bathtub according to claim 1, further comprising at least one second aperture in the recessed area in communication with said channel extension, said at least one second aperture allowing fluid located within said channel to drain into said drain.

5. The bathtub according to claim 1, further comprising a blower or compressed air source for forcing air through said first apertures.

6. The bathtub according to claim 5, further comprising a heater for heating said air.

7. The bathtub according to claim 6, wherein the blower or compressed air source is in fluid communication with said channel.

8. The bathtub according to claim 1, further comprising a waste water pipe connected to said drain.

9. The bathtub according to claim 1, wherein said first apertures are located on said side walls.

10. The bathtub according to claim 1, wherein said channel is continuous.

11. The bathtub according to claim 10 wherein said channel includes a connection to a blower.

12. The bathtub according to claim 1, wherein said channel allows fluid located in said channel to drain through said channel extension and into the recessed area.

13. The bathtub according to claim 12 wherein said channel provides a drainage percentage of greater than 97%.

14. A bathtub comprising:

a bath well defined by side walls and a bottom portion, said bottom portion including a recessed area extending below and surrounded by said bottom portion;

a drain located within the recessed area;

a channel located above said bottom portion and extending around said bath well, said channel disposed outside of said bath well;

a channel extension arranged between said channel and the recessed area such that said channel is in communication with the recessed area;

a plurality of first apertures in said bath well, at least some of said first apertures extending into said channel; and a blower for forcing air into said channel and through said first apertures.

15. The bathtub according to claim 14 wherein said channel is tilted towards said recessed area.

16. The bathtub according to claim 14 wherein a portion of said channel extends at least partially around the recessed area.

17. The bathtub according to claim 14 further comprising at least one second aperture in the recessed area in communication with said channel extension, said at least one second aperture allowing fluid located within said channel to drain into said drain.

18. The bathtub according to claim 14 further comprising a heater for heating said air.

19. The bathtub according to claim 14 further comprising a waste water pipe connected to said drain.

20. The bathtub according to claim 14 wherein said channel is continuous.

21. The bathtub according to claim 14 wherein said first apertures are located on said side walls.

22. The bathtub according to claim 14 wherein said channel provides a drainage percentage of greater than 97%.

23. A bathtub comprising:

a bath well defined by side walls and a bottom portion, said bottom portion including a recessed area extending below and surrounded by said bottom portion;

a drain located within the recessed area;

a channel located above said bottom portion and extending around said bath well;

a channel extension arranged between said channel and the recessed area such that said channel is in communication with the recessed area;

a plurality of first apertures located on said side walls of said bath well, at least some of said first apertures extending into said channel; and at least one second aperture in the recessed area in communication with said channel extension, said at least one second aperture allowing fluid located within said channel to drain into said drain.

24. The bathtub according to claim 23 wherein said channel is tilted towards the recessed area.

25. The bathtub according to claim 23 further comprising a waste water pipe connected to said drain.

26. The bathtub according to claim 23 wherein said channel is continuous.

27. The bathtub according to claim 23 wherein said channel provides a drainage percentage of greater than 97%.

28. The bathtub according to claim 23 further comprising a blower for forcing air into said channel and through said first apertures.

29. The bathtub according to claim 28 further comprising a heater for heating said air.

* * * * *